US009734816B2

(12) United States Patent
Maeda et al.

(10) Patent No.: US 9,734,816 B2
(45) Date of Patent: Aug. 15, 2017

(54) NOISE REDUCTION DEVICE

(71) Applicant: Panasonic Intellectual Property Management Co., Ltd., Osaka (JP)

(72) Inventors: Tsuyoshi Maeda, Hyogo (JP); Yoshifumi Asao, Hyogo (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 15/002,666

(22) Filed: Jan. 21, 2016

(65) Prior Publication Data

US 2016/0225366 A1 Aug. 4, 2016

(30) Foreign Application Priority Data

Feb. 2, 2015 (JP) ..... 2015-018567
Dec. 18, 2015 (JP) ..... 2015-246829

(51) Int. Cl.
*G10K 11/178* (2006.01)

(52) U.S. Cl.
CPC .. *G10K 11/1784* (2013.01); *G10K 2210/1281* (2013.01); *G10K 2210/3027* (2013.01); *G10K 2210/3219* (2013.01)

(58) Field of Classification Search
CPC .... G10K 11/16; G10K 11/002; G10K 11/178; H04R 3/00; H04R 1/08
USPC ..... 381/71.1, 71.4, 73.1
See application file for complete search history.

(56) References Cited

U.S. PATENT DOCUMENTS

2007/0223714 A1* 9/2007 Nishikawa ..... G10K 11/1788 381/71.1
2008/0181422 A1* 7/2008 Christoph ..... G10K 11/1784 381/73.1
2008/0317254 A1* 12/2008 Kano ..... G10K 11/1786 381/71.4
2010/0014683 A1 1/2010 Maeda et al.
2010/0208911 A1 8/2010 Maeda et al.
2013/0208906 A1* 8/2013 Asao ..... G10K 11/178 381/71.4

FOREIGN PATENT DOCUMENTS

JP 07-160280 6/1995
JP 10-171468 6/1998
JP 2010-023534 A 2/2010
JP 2010-188752 A 9/2010

* cited by examiner

*Primary Examiner* — Mohammad Islam
(74) *Attorney, Agent, or Firm* — McDermott Will & Emery LLP

(57) ABSTRACT

A noise reduction device includes a plurality of noise microphones, noise controller, and control speakers. Noise controller generates a control-sound signal to reduce a noise, at a control center of a control space, with the noise being detected by the plurality of noise microphones. Noise microphone disposed at a shorter distance from the control center than distance "d" indicated by Relational Expression (1) is smaller in number than noise microphones disposed at longer distances than distance "d" where "λ" is a wavelength corresponding to control upper-limit frequency "f" in noise microphones, "d0" is a distance from the control center to control speakers, "t" is a control delay time in control speakers, and "v" is a sound speed.

$$d=d0+t\times v-\lambda/2 \quad (1)$$

5 Claims, 21 Drawing Sheets

Noise microphones, 12-units
$d_{max}$-$d_{min}$< $\lambda/2$

NOISE REDUCTION DEVICE

RELATED APPLICATIONS

This application claims the benefit of priority of Japanese Application No. 2015-018567, filed on Feb. 2, 2015 and Japanese Application No. 2015-246829, filed on Dec. 18, 2015, the disclosures of which are incorporated by reference herein.

BACKGROUND

1. Technical Field

The present disclosure relates to noise reduction devices used on the insides of closed-structure bodies including aircraft and railway vehicles.

2. Description of the Related Art

Japanese Patent Unexamined Publication No. H07-160280 discloses the method of enhancing an effect of eliminating low-frequency components of a noise, which is applied to silencers for electrical equipment such as air conditioners. The enhancement is achieved by taking consideration of, in the silencers, installation positions of a microphone and speaker, and a delay time between time of noise propagation and time of emitting a control sound from the speaker. Japanese Patent Unexamined Publication No. H10-171468 discloses the method of enhancing an effect of silencing a random noise. The enhancement is achieved by taking consideration of an installation position of a speaker relative to a place (referred to also as "silencing center" or "control point," hereinafter) where the noise is reduced. Japanese Patent Unexamined Publication No. 2010-188752 discloses the method of effectively exhibiting an effect of reducing a noise even under circumstances that the time causality constraints are not satisfied because of an unfavorable positional relation between a noise-detecting microphone and speaker and the silencing center. Such an effect is achieved by setting a control upper-limit frequency.

SUMMARY

A noise reduction device according to the present disclosure includes a plurality of noise detecting units, a noise controller, and a control-sound outputting unit. The plurality of noise detecting units detects a noise. The noise controller generates a control-sound signal to reduce, at a control center of a control space, the noise detected by the noise detecting units. The control-sound outputting unit outputs a sound based on the control sound signal. The number of the control-sound outputting units disposed at shorter distances from the control center than distance "d" indicated by following Relational Expression is small compared to the number of the control-sound outputting units disposed at longer distances from the control center than distance "d," where "λ" is a wavelength corresponding to control upper-limit frequency "f" in the noise detecting units, "d0" is a distance from the control center to the control-sound outputting unit, "t" is a control delay time in the control-sound outputting unit, and "v" is a sound speed.

$$d=d0+t\times v-\lambda/2$$

DETAILED DESCRIPTION

Hereinafter, detailed descriptions of embodiments will be made with reference to the accompanying drawings as deemed appropriate. However, descriptions in more detail than necessary will sometimes be omitted. For example, detailed descriptions of well-known items and duplicate descriptions of substantially the same configuration will sometimes be omitted, for the sake of brevity and easy understanding by those skilled in the art. Note that the accompanying drawings and the following descriptions are presented to facilitate fully understanding of the present disclosure by those skilled in the art, and are not intended to impose any limitations on the subject matter described in the appended claims.

First Exemplary Embodiment

A device according to a first embodiment of the present disclosure will be described as below, with reference to FIGS. 1 to 7.

Hereinafter, a description is made using a case where a noise reduction device according to the embodiment is installed in aircraft 100.

Figure 1:
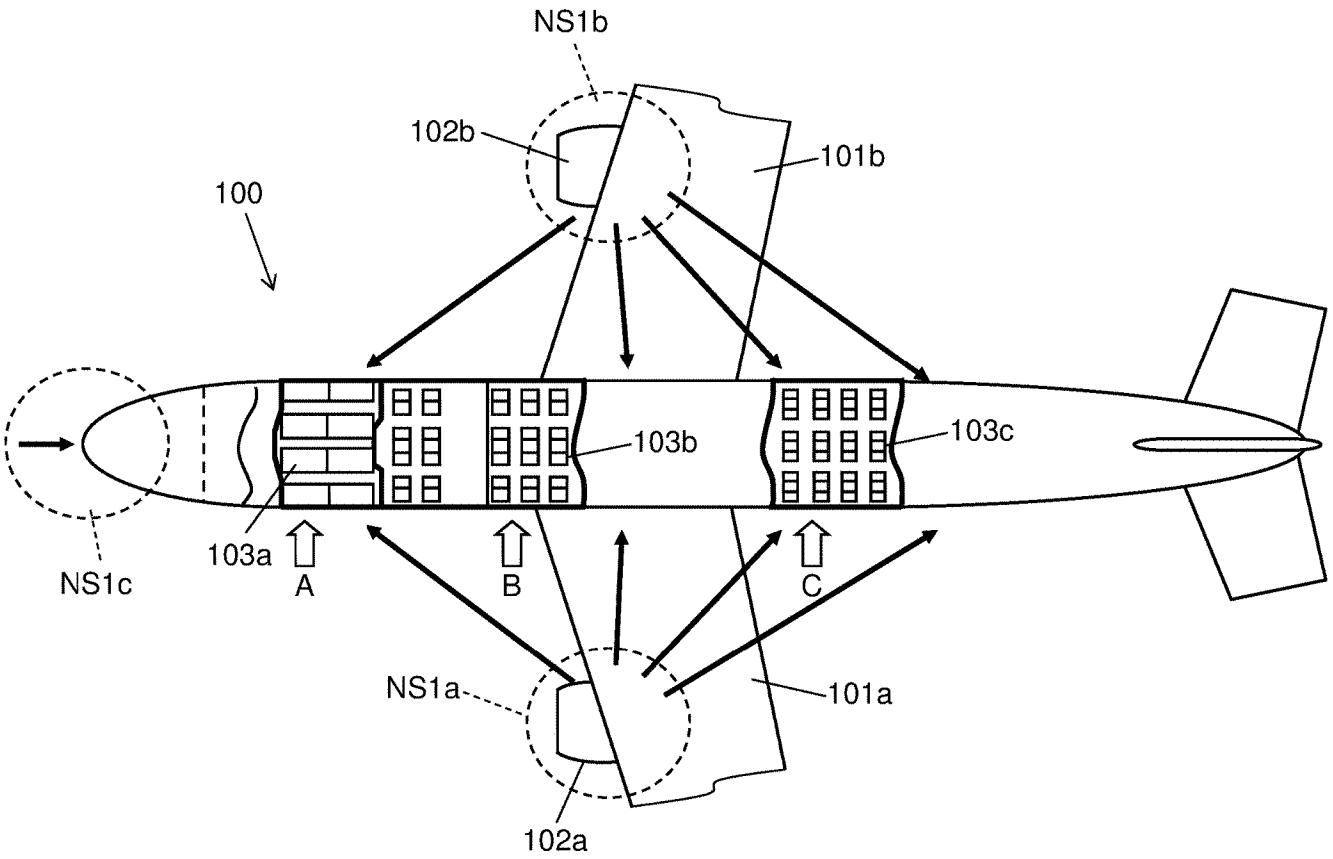
FIG. 1 is a plan view of a configuration of a cabin of an aircraft in which a noise reduction device is installed according to an embodiment of the present disclosure.
Figure 2:
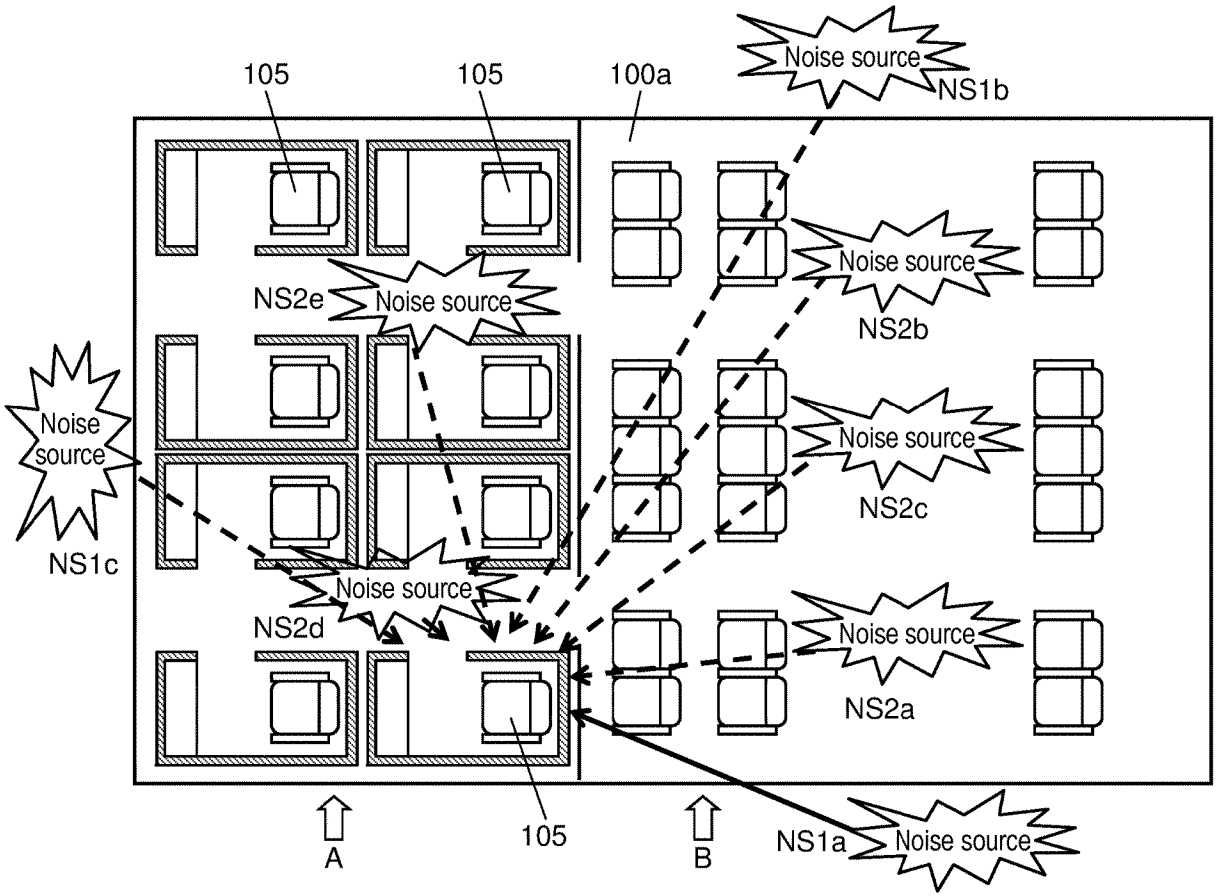
FIG. 2 is an enlarged plan view of the configuration of the cabin shown in FIG. 1.

First, a sound environment in aircraft 100 is described which requires installation of the noise reduction device, with reference to FIGS. 1 and 2.

FIG. 1 is a plan view illustrating the environment (on the inside of aircraft 100) in which the noise reduction device is installed according to the embodiment.

Aircraft 100 includes, as shown in FIG. 1, left and right wings 101*a* and 101*b*, and engines 102*a* and 102*b* mounted to wings 101*a* and 101*b*, respectively.

Here, in view of the sound environment of the space inside aircraft 100, sounds emitted from engines 102*a* and 102*b* play an important role as noise sources because they contain sounds associated with reverberations of air streams during a flight as well as rotation sounds.

Engines 102*a* and 102*b* act as external noise sources NS1*a* and NS1*b* for seat rows 103*a*, 103*b*, and 103*c* which are arranged in cabin A (e.g. first class), cabin B (e.g. business class), and cabin C (e.g. economy class) of the aircraft, respectively, for example. Moreover, high speed travelling of aircraft 100 entails an air-stream collision noise (wind noise) with both the airframe's nose cone, and wings 101*a* and 101*b*. Such a collision noise also acts as noise source NS1*c* for the cabin, resulting in bad influence on information service and the like in the cabin.

FIG. 2 is a plan view illustrating details of the environment in which the noise reduction device is installed, showing an enlarged illustration of the seat arrangement in a part of cabins A and B shown in FIG. 1.

Cabin 100*a* is sectioned by walls into cabin A and cabin B. In cabins A and B, sat rows 103*a*, 103*b* are disposed, respectively.

As to the sound environment in cabin 100*a*, the external noise sources include: noise sources NS1*a* and NS1*b* caused by engines 102*a* and 102*b*, and the wind noise (noise source NS1*c*) generated at the airframe's nose cone. In addition, noise sources NS2*a* to NS2*e* are present on the inside of cabin 100*a*, which are caused by air conditioners and the like.

Here, a case is considered where one seat 105 arranged in cabin A suffers from the noises caused by these noise sources. Seat 105 is influenced by the noises including: ones from noise sources NS1*a* to NS1*c* caused by the air stream sound and engine 102*a*, 102*b* (see FIG. 1) mounted to the wing outside the window, and ones from noise sources NS2*a* to NS2*e* caused by the air conditioner.

In particular, seat 105 in cabin A has a shell structure, e.g. in the first class and like shown in FIG. 1. Such a shell is equipped with audio-visual appliances such as a television and radio receivers for enjoying movies and music, a desk for a businessperson, a power receptacle for PCs, and so on, in the shell's inside. Moreover, seat 105 in such as the first class is strongly required to offer a passenger an excellent environment for relaxing comfortably, concentrating on business, etc. For this reason, noise reduction inside the shell structure has been strongly demanded.

Figure 3B:
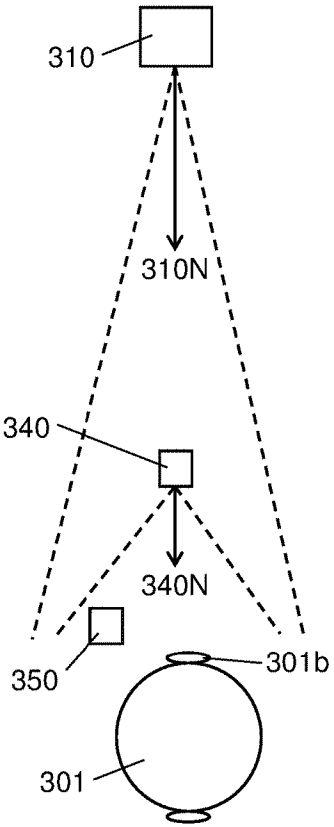
FIG. 3B is a view illustrating a method of superimposing a control sound emitted from a control-sound generating unit onto a noise emitted from a noise source.
Figure 3A:
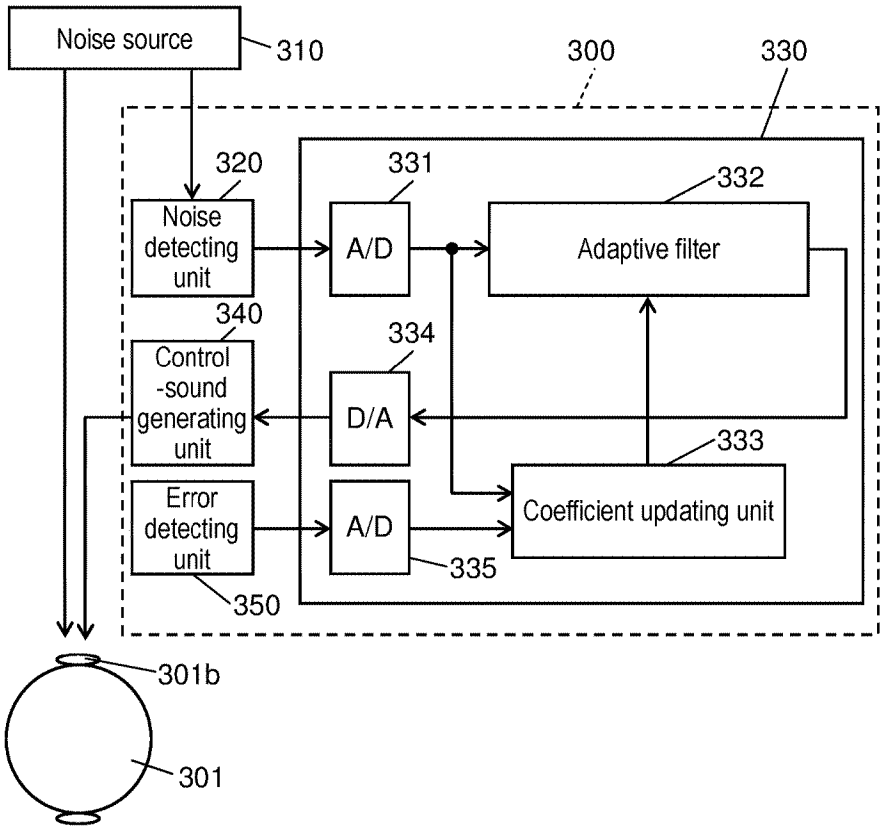
FIG. 3A is a block diagram of a basic configuration of the noise reduction device installed in the aircraft shown in FIG. 1.

FIG. 3A is a block diagram of a basic configuration of the noise reduction device according to the embodiment.

Noise reduction device 300 is a feed-forward noise reduction device (see FIG. 5), and includes noise detecting unit 320, noise controller 330, control-sound generating unit 340, and error detecting unit 350, as shown in FIG. 3A.

Hereinafter, configurations and functions of these units are described.

Noise detecting unit 320 is a microphone for detecting a noise emitted from noise source 310 (such a microphone is referred simply to as a noise microphone, hereinafter), which converts the detected noise information into an electric signal and then outputs it.

Error detecting unit 350 is a microphone for detecting a residual sound (error sound) which is formed by superimposing a control sound emitted from control-sound generating unit 340 onto the noise emitted from noise source 310 (such a microphone is referred simply to as an error microphone, hereinafter). The error microphone converts the error sound into an electric signal and then outputs it.

As shown in FIG. 3A, noise controller 330 includes A/D converters 331 and 335, adaptive filter 332, coefficient updating unit 333, and D/A converter 334. Then, noise controller 330 generates a control-sound signal such that the detected error is minimized, based on both noise information from noise detecting unit 320 and error information from error detecting unit 350.

Control-sound generating unit 340 is a speaker for converting the control-sound signal, which is received from D/A converter 334, into a sound wave and outputting it. This sound output from the speaker is the control sound having the opposite phase to the noise which reaches the proximity of ear 301*b* of user 301, thereby canceling the noise.

Adaptive filter 332 is configured including multistage taps, and is a finite impulse response (FIR) filter capable of freely setting a filter coefficient of each tap. Coefficient updating unit 333 is fed, via A/D converter 335, with a detected-error signal from error detecting unit 350, as well as the information output from noise detecting unit 320. Then, coefficient updating unit 333 adjusts each of the filter coefficients of adaptive filter 332 such that the detected error is minimized. That is, the adaptive filter generates the control-sound signal which will have the opposite phase to the noise from noise source 310 at the installation position of error detecting unit 350, and outputs the resulting signal to control-sound generating unit 340 via D/A converter 334.

A/D converter 331 applies A/D conversion to the noise signal from noise detecting unit 320, and outputs the resulting signal to both adaptive filter 332 and coefficient updating unit 333.

Error detecting unit 350 detects a post-reduction noise as an error, and feeds the error back into the operation result of noise reduction device 300. This operation allows the noises to be always minimized at the positions of the user's ears even if the noise environment and the like changes.

In noise reduction device 300 according to the embodiment, as shown in FIG. 3A, noise detecting unit 320 detects the noise emitted from noise source 310. Then, in noise reduction device 300, noise controller 330 performs signal processing of the noise signal. Then, control-sound generating unit 340 emits, to ear 301*b* of user 301, the control sound having the opposite phase to the noise emitted from noise source 310, with the control sound being superimposed onto the noise. This operation causes the control sound having the opposite phase and the noise to cancel each other, resulting in the reduced noise.

FIG. 3B illustrates a method of superimposing the control sound emitted from control-sound generating unit 340 onto the noise emitted from noise source 310.

As shown in FIG. 3B, control-sound generating unit 340 is disposed on principal reaching path 310N of the noise, with the path connecting between noise source 310 and ear 301*b* of user 301.

With this configuration, the control sound having the opposite phase relative to the noise is emitted along principal reaching path 340N, which allows the control sound to reach ear 301*b* of user 301, with the control sound being superimposed onto the noise. Moreover, error detecting unit 350 is disposed within a region of the superimposition. This allows the error detecting unit to detect the post-reduction sound, as an error, and to feed it back into the operation result of noise reduction device 300, thereby enhancing the noise reduction effect.

Figure 4:
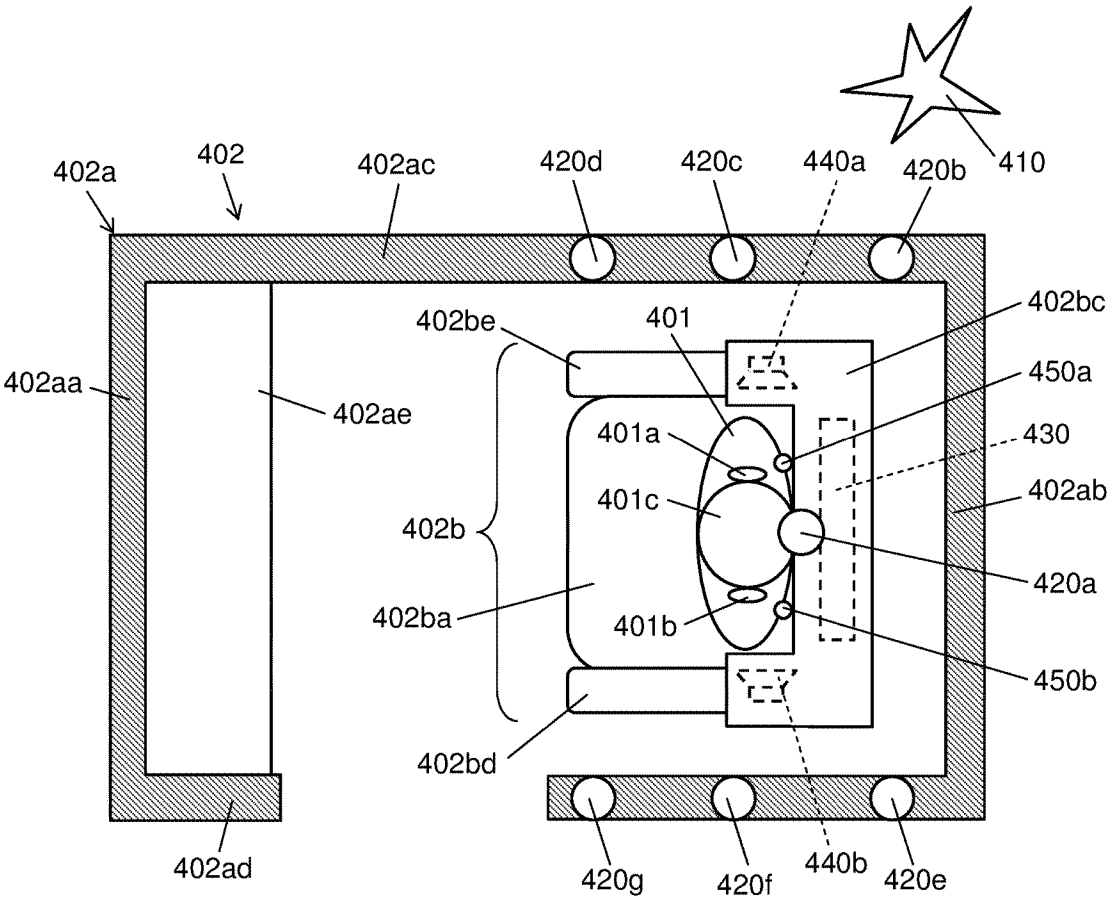
FIG. 4 is a plan view of an example of an arrangement of the noise reduction device installed around a seat in the cabin of the aircraft shown in FIG. 1.
Figure 5:
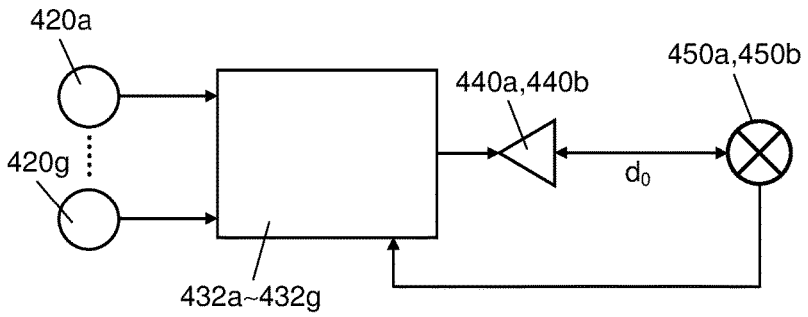
FIG. 5 is a block diagram of a basic configuration of a feed-forward noise reduction device.

Next, the noise reduction device according to the embodiment will be described for the case where the device is disposed in the cabin of an aircraft, with reference to FIGS. 4 and 5. FIG. 4 is a plan view of a principal configuration of the noise reduction device installed in the cabin of the aircraft. Moreover, FIG. 5 is a block diagram of a basic configuration of the feed-forward noise reduction device corresponding to the noise reduction device shown in FIG. 4.

The noise reduction device is arranged in cabin A (FIG. 1) of the aircraft, and disposed in seat 402 serving as a control space in which the noise is controlled.

Seat 402 includes: shell part 402*a* surrounded with walls to define a shell-like space for a private area of the user, and seat part 402*b* disposed on the inside of shell part 402*a*.

Shell part 402*a* is surrounded, from four directions, with front wall 402*aa*, back wall 402*ab*, side wall 402*ac*, and side wall 402*ad*.

In side wall 402*ad*, an opening is formed for the user to come into and go out from shell part 402*a*.

Moreover, shell part 402*a* is equipped with shelf 402*ae* in front of seat part 402*b*, at a position surrounded by front wall 402*aa* and side walls 402*ac* and 402*ad*. Shelf 402*ae* is used as a desk.

Seat part 402*b* includes: a backrest (not shown), seat cushion 402*ba* on which user 401 is seated, headrest 402*bc*, and armrests 402*bd* and 402*be*. Moreover, on the inside of the backrest of seat part 402*b*, noise controller 430 (corresponding to noise controller 330 shown in FIG. 3A) is disposed.

As to the sound environment in cabin A of the aircraft, the noise sources involve engines 102*a* and 102*b* mounted to the airframe, the air conditioners installed inside the cabin, and the like. In the proximity of seat 402, the noises from these noise sources reach the periphery of shell part 402*a*.

As shown in FIG. 4, for example, seat 402 is physically insulated from the noises emitted from external noise sources 410, by shell part 402*a* surrounding the periphery of seat 402. Moreover, the noises having entered the inside of shell part 402*a* from noise sources 410 will reach the proximity of head 401*c* of user 401 being seated on seat part 402*b*.

Note that, in cases where the principal reaching path is difficult to specify due to the presence of such various kinds of noise sources as those in an aircraft, a plurality of nondirectional noise microphones is disposed in shell part 402*a* (control space) or the proximity of the shell part.

FIG. 4 shows the case where there are disposed, at predetermined positions in shell part 402*a*, noise microphones 420*a* to 420*g* (corresponding to noise detecting unit 320 shown in FIG. 3A), and where there are disposed, in the seat, both control speakers 440*a* and 440*b* (corresponding to control-sound generating unit 340 shown in FIG. 3A) and error microphones 450*a* and 450*b* (corresponding to error detecting unit 350 shown in FIG. 3A).

In the noise reduction device according to the embodiment, as shown in FIG. 4, the inside of shell part 402*a* is defined as the control space in seat 402, and error microphones 450*a* and 450*b* are defined as the control centers, with the error microphones being disposed in the proximity of ears 401*a* and 401*b* of user 401 being seated on seat part 402*b*.

In the noise reduction device, as shown in FIG. 5, a feed-forward configuration is employed which operates as follows. That is, a noise is detected by noise microphones 420*a* to 420*g*, and control sounds having the opposite phase to the noise are emitted from control speakers 440*a* and 440*b* by the time the noise reaches both error microphones 450*a* and 450*b* serving as the control centers, thereby reducing the noise.

Moreover, in the noise reduction device according to the embodiment, as shown in FIG. 4, noise microphone 420*a* (second noise detecting unit) is disposed at a close position to error microphones 450*a* and 450*b*, serving as the control centers, relative to the other noise microphones 420*b* to 420*g* (first noise detecting units). Specifically, the second noise detecting unit is disposed in the proximity of headrest 402*bc* in seat 402.

On the other hand, the other noise microphones 420*b* to 420*g* are disposed in respective side walls 402*ac* and 402*ad* of shell part 402*a* covering the periphery of seat 402, with the side walls covering the sides of seat 402.

That is, in the embodiment, in order to effectively perform the reduction processing of the noise that reaches ears 401*a* and 401*b* of user 401 being seated on seat 402, one noise microphone 420*a* is disposed on the inside of shell part 402*a* and six noise microphones 420*b* to 420*g* are disposed in side walls 402*ac* and 402*ad* of shell part 402*a* sorrounding the periphery of seat 402.

Figure 6:
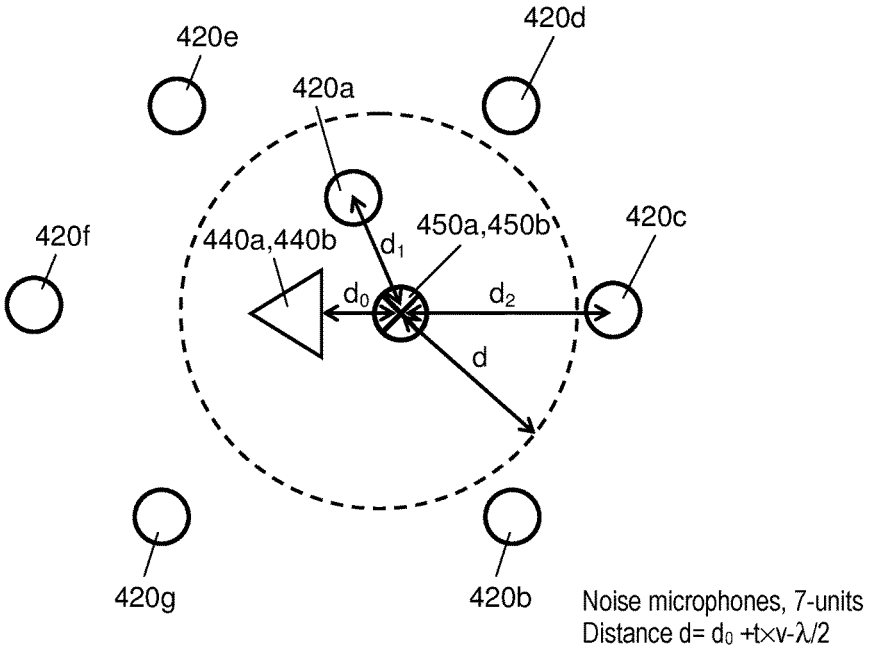
FIG. 6 is a schematic view of an arrangement of noise microphones and the like in the noise reduction device shown in FIG. 4.
Figure 7:
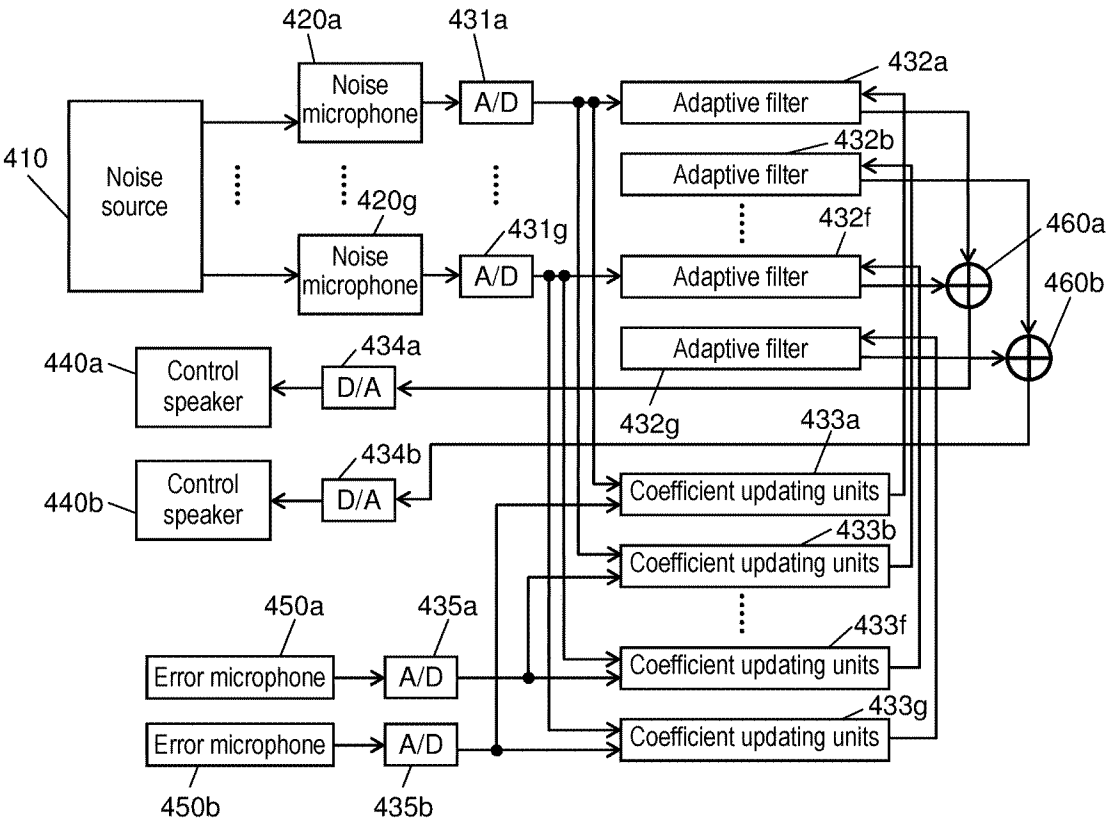
FIG. 7 is a block diagram of a configuration in which pluralities of noise microphones and error microphones are used in the noise reduction device shown in FIG. 3A.

Now, the arrangement positions of these noise microphones 420*a* to 420*g* are described in terms of their distances from the control center, with reference to FIG. 6.

That is, in the noise reduction device of the embodiment, of seven noise microphones 420*a* to 420*g*, only noise microphone 420*a* is disposed at a short distance from the control center (error microphones 450*a* and 450*b*).

Specifically, as shown in FIG. 6, noise microphone 420*a* is disposed at the position that satisfies the following Relational Expressions (1) and (2), where "d0" is a distance of control speakers 440*a* and 440*b* from the control center (error microphones 450*a* and 450*b*), and "d1" is a distance of noise microphone 420*a* from the control center. That is, $$d=d0+t\times v-\lambda/2, \quad (1)$$

$$d1<d. \quad (2)$$

(Note that "t" is a control delay time in the control speaker; "v" is a sound speed; "λ" is a wavelength corresponding to control upper-limit frequency "f." The control delay time in the control speaker corresponds to the sum of a delay time in noise controller 330 and a delay time in control-sound generating unit 340, both shown in FIG. 3A.)

On the other hand, noise microphones 420*b* to 420*g* are disposed at the respective positions that satisfy the following Relational Expression (3), where "d2" is a distance of each of noise microphones 420*b* to 420*g* from the control center, $$d2>d. \quad (3)$$

That is, in the noise reduction device according to the embodiment, noise microphone 420*a* is disposed inside the region (dashed-line circle) defined by distance "d" from the control center, and noise microphones 420*b* to 420*g* are disposed outside the dashed-line circle, as shown in FIG. 6.

Here, effects of the arrangement of the noise microphones are discussed. In general, in cases where the noise microphones are disposed only at close positions to the control center, causality is not satisfied, allowing only a little effect on the degree to which low-frequency (e.g. not higher than 300 Hz) sounds are reduced a little.

In contrast, in cases where the noise microphones are disposed only at distant positions from the control center, the causality is satisfied, allowing a noise reducing effect over a wide frequency band. Unfortunately, such a configuration results in a decrease in correlation between the noise detected by the noise microphones and the noise reaching the control center, causing a problem, that is, a decrease in sound volume by which the noise is reduced.

Given this situation, in the noise reduction device according to the embodiment, distance "d" from the control center is set as a reference, and the noise microphones are disposed at both close and distant positions to and from the control center, relative to the reference distance "d." In addition, the number of noise microphone 420*a* (one unit) disposed at the closer position than distance "d" is smaller than the number of noise microphones 420*b* to 420*g* (six units) disposed at the more distant positions than distance "d."

This configuration allows compatibility of two effects, that is, the effect of satisfying the causality and the effect of enhancing the correlation, resulting in the noise reduction effect over a wide frequency band.

In general, for achieving the same correlation, the required number of the noise microphones is smaller for ones disposed at the close positions than for ones disposed at the distant positions. Besides this, such a correlation determines the amount of noise reduction. Therefore, the number of the noise microphones at close positions can be set to be smaller than the number of the noise microphones at distant positions. With this configuration, even with the smaller total number of these noise microphones, it is possible to achieve the noise reduction effect over the wide frequency band, with costs and complexity of control-signal processing being reduced.

More specifically, in the noise reduction device according to the embodiment, each of noise microphones 420*a* to 420*g* is disposed such that Relational Expressions (1) to (3) described above are satisfied.

With this configuration, the correlation can be held in a high level between the noise detected by noise microphones 420*a* to 420*g* and the noise actually reaching the proximity of the ears of user 401, with the causality in the noise reduction control being satisfied. Therefore, even in cases where many noise sources are present and noises come from various directions, as in the cabin of aircraft 100, it is possible to effectively reduce the noises over a wide frequency band, from lower to higher frequencies.

Note that the noise reducing effect of the noise reduction device according to the embodiment will be described by using the following Example, together with the result of a verification of the effect, by using Comparative Examples.

Here, of noise microphones 420*a* to 420*g*, noise microphones 420*b* to 420*g* disposed more distant than distance "d" from the control center may be intended explicitly for a higher frequency range, while noise microphone 420*a* disposed closer than distance "d" may be intended explicitly for a lower frequency range.

However, in the embodiment, via their filter responses, adaptive filters 432*a* to 432*g* change their configurations automatically such that noise microphone 420*a* disposed at the closer position will operate for reducing mainly low-frequency noises. Accordingly, all adaptive filters 432*a* to 432*g*, which are each disposed at the closer or more distant position than distance "d," can commonly employ wide-band microphones.

In other words, assuming that "f1" is the control upper-limit frequency of noise microphone 420*a* for a lower frequency range and that "f2" is the control upper-limit frequency of noise microphones 420*b* to 420*g* for a higher frequency range, then f1<f2 in actual use.

Incidentally, the control upper-limit frequency of noise microphone 420*a* disposed at the position closer than distance "d" is not higher than 300 Hz, for example.

Next, as described above, the noise reduction device according to the embodiment is configured with the plurality of noise microphones 420*a* to 420*g*, control speakers 440*a* and 440*b*, and error microphones 450*a* and 450*b*. Accordingly, the control block diagram in actual use is one shown in FIG. 7, not so simple as that shown in FIG. 3A.

Note that, noise microphones 420*a* to 420*g*, A/D converters 431*a* to 431*g*, adaptive filters 432*a* to 432*g*, coefficient updating units 433*a* to 433*g*, D/A converters 434*a* and 434*b*, A/D converters 435*a* and 435*b*, control speakers 440*a* and 440*b*, and error microphones 450*a* and 450*b*, respectively correspond to noise detecting unit 320, A/D converter 331, adaptive filter 332, coefficient updating unit 333, D/A converter 334, A/D converter 335, control-sound generating unit 340, and error detecting unit 350 shown in FIG. 3. Accordingly, detailed descriptions of functions of the configurations of these elements are omitted.

In the noise reduction device according to the embodiment, the noise emitted from noise source 410 is detected by each of noise microphones 420*a* to 420*g*.

The noise detected by each of noise microphones 420*a* to 420*g* is converted into a digital signal by respective A/D converters 431*a* to 431*g*, and then inputted to respective adaptive filters 432*a* to 432*g*.

The filter coefficients of each of adaptive filters 432*a* to 432*g* are adjusted, by respective coefficient updating units 433*a* to 433*g*, to minimize the error detected by respective error microphones 450*a* and 450*b*.

The outputs from adaptive filters 432*a* to 432*g* are added, by adders 460*a* and 460*b*, and then transmitted to control speakers 440*a* and 440*b* via D/A converters 434*a* and 434*b*, thereby emitting the control sounds.

Then, the post-noise-reduction sounds detected by error microphones 450*a* and 450*b* are converted into digital signals by respective A/D converters 435*a* and 435*b*, and transmitted to respective coefficient updating units 433*a* to 433*g* which adjust the filter coefficients of respective adaptive filters 432*a* to 432*g*.

With this configuration, even in the configuration including the plurality of noise microphones 420*a* to 420*g*, control speakers 440*a* and 440*b*, and error microphones 450*a* and 450*b*, and yet even in cases where many noise sources are present and noises come from various directions as in the cabin of aircraft 100, as described above, it is possible to effectively reduce the noises over a wide frequency band, from lower to higher frequencies.

EXAMPLE

The noise reducing effect of the Example of the noise reduction device according to the embodiment will be described together with Comparative Examples, as follows.

Figure 8:
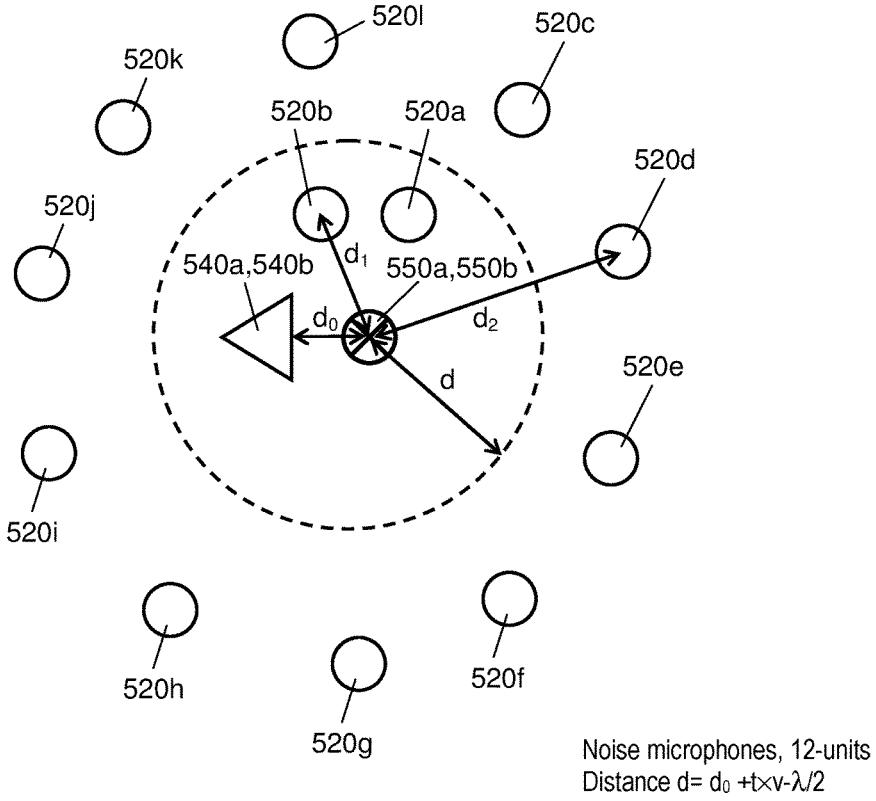
FIG. 8 is a view of an example of an arrangement of the noise microphones and the like in the noise reduction device according to the embodiment.

That is, in the Example, the noise reducing effect has been verified for the noise reduction device that includes twelve noise microphones 520*a* to 520*l*, two control speakers 540*a* and 540*b*, and two error microphones 550*a* and 550*b* serving as the control center, as shown in FIG. 8.

Here, as described above, distance "d0" is a distance from the control center (error microphones 550*a* and 550*b*) to control speakers 540*a* and 540*b*.

Noise microphones (first noise detecting unit) 520*a* and 520*b* are disposed on the inside of the dashed-line circle shown in FIG. 8 such that distance "d1" is shorter than distance "d" indicated by Relational Expression (1) described above, where distance "d1" is a distance from the control center (error microphones 550*a* and 550*b*) to the noise microphones.

On the other hand, noise microphones (second noise detecting unit) 520*c* to 520*l* are disposed on the outside of the dashed-line circle shown in FIG. 8 such that distance "d2" is longer than distance "d" indicated by the following Relational Expression (1) described above, where distance "d2" is a distance from the control center (error microphones 550*a* and 550*b*) to the noise microphones.

$$d=d0+t\times v-\lambda/2 \quad (1)$$

That is, in the Example, noise microphones 520*a* to 520*j* are disposed to satisfy Relational Expressions (2) and (3) (d1<d, d2>d) described above.

Next, Comparative Examples 1 and 2 will be described below which are compared with the Example to verify the noise reducing effect of the Example.

Comparative Example 1

Figure 9:
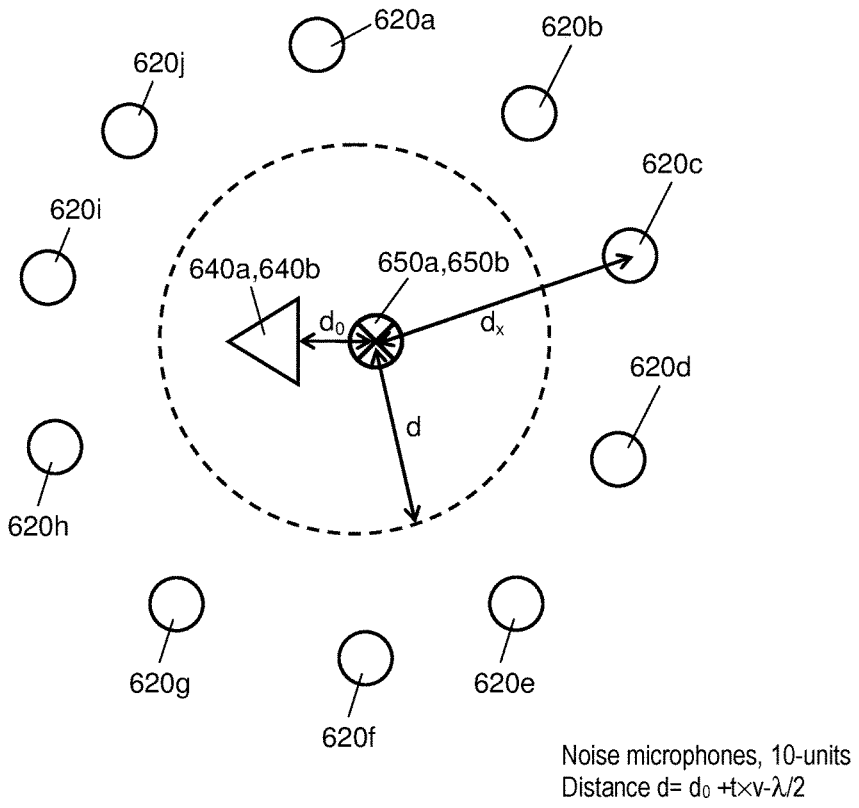
FIG. 9 is a view of an example of an arrangement of noise microphones and the like in a noise reduction device of a comparative example to the embodiment.

In the Comparative Example, the noise reducing effect of a comparative noise reduction device has been verified, with the device including ten noise microphones 620*a* to 620*j*, two control speakers 640*a* and 640*b*, and two error microphones 650*a* and 650*b* serving as the control center, as shown in FIG. 9.

Here, in the same way as described above, distance "d0" is a distance from the control center (error microphones 650*a* and 650*b*) to control speakers 640*a* and 640*b*.

In the Comparative Example, all of ten noise microphones 620*a* to 620*j* are disposed on the outside of the dashed-line circle shown in FIG. 9 such that distance "dx" is longer than distance "d" indicated by the following Relational Expression (1) described above, where distance "dx" is a distance from the control center (error microphones 650*a* and 650*b*) to the noise microphones.

$$d=d0+t\times v-\lambda/2 \quad (1)$$

That is, in the Comparative Example, noise microphones 620*a* to 620*j* are disposed to satisfy the relation of dx>d.

Comparative Example 2

Figure 10:
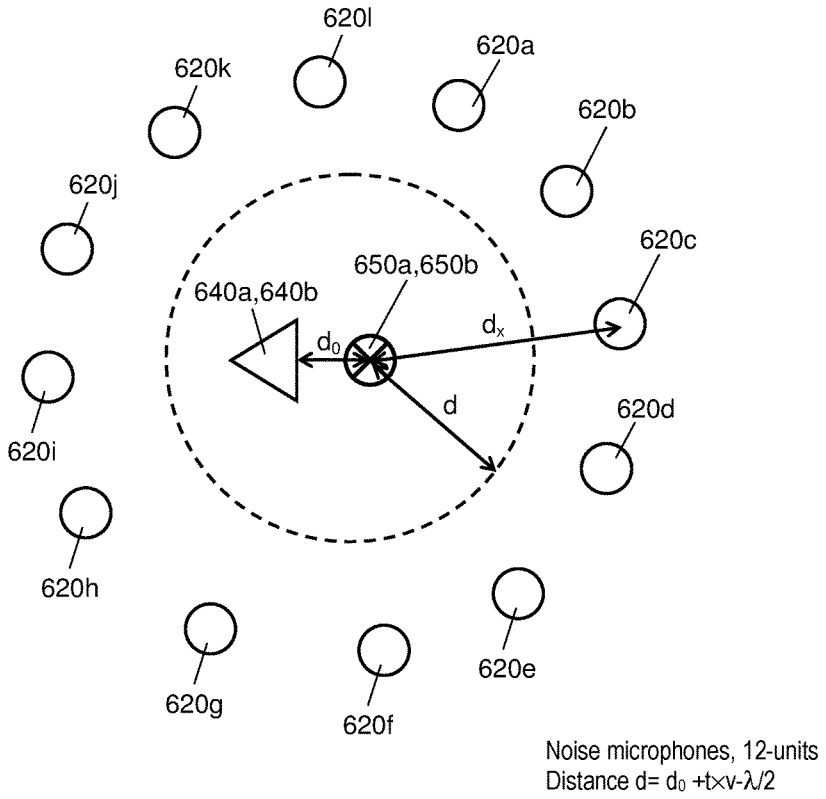
FIG. 10 is a view of an example of an arrangement of the noise microphones and the like in a noise reduction device of a comparative example to the embodiment shown in FIG. 8.

In the Comparative Example, the noise reducing effect of a comparative noise reduction device has been verified, with the device including twelve noise microphones 620*a* to 620*l*, two control speakers 640*a* and 640*b*, and two error microphones 650*a* and 650*b* serving as the control center, as shown in FIG. 10.

Here, in the same way as described above, distance "d0" is a distance from the control center (error microphones 650*a* and 650*b*) to control speakers 640*a* and 640*b*.

In the Comparative Example, all of twelve noise microphones 620*a* to 620*l* are disposed on the outside of the dashed-line circle shown in FIG. 10 such that distance "dx" is longer than distance "d" indicated by the following Relational Expression (1) described above, where distance "dx" is a distance from the control center (error microphones 650*a* and 650*b*) to the noise microphones.

$$d=d0+t\times v-\lambda/2 \quad (1)$$

That is, in the Comparative Example as well, noise microphones 620*a* to 620*j* are disposed to satisfy the relation of dx>d, in the same way as for Comparative Example 1 described above.

Verification Result of Noise Reducing Effects of Configurations of Example and Comparative Examples 1, 2

Figure 11:
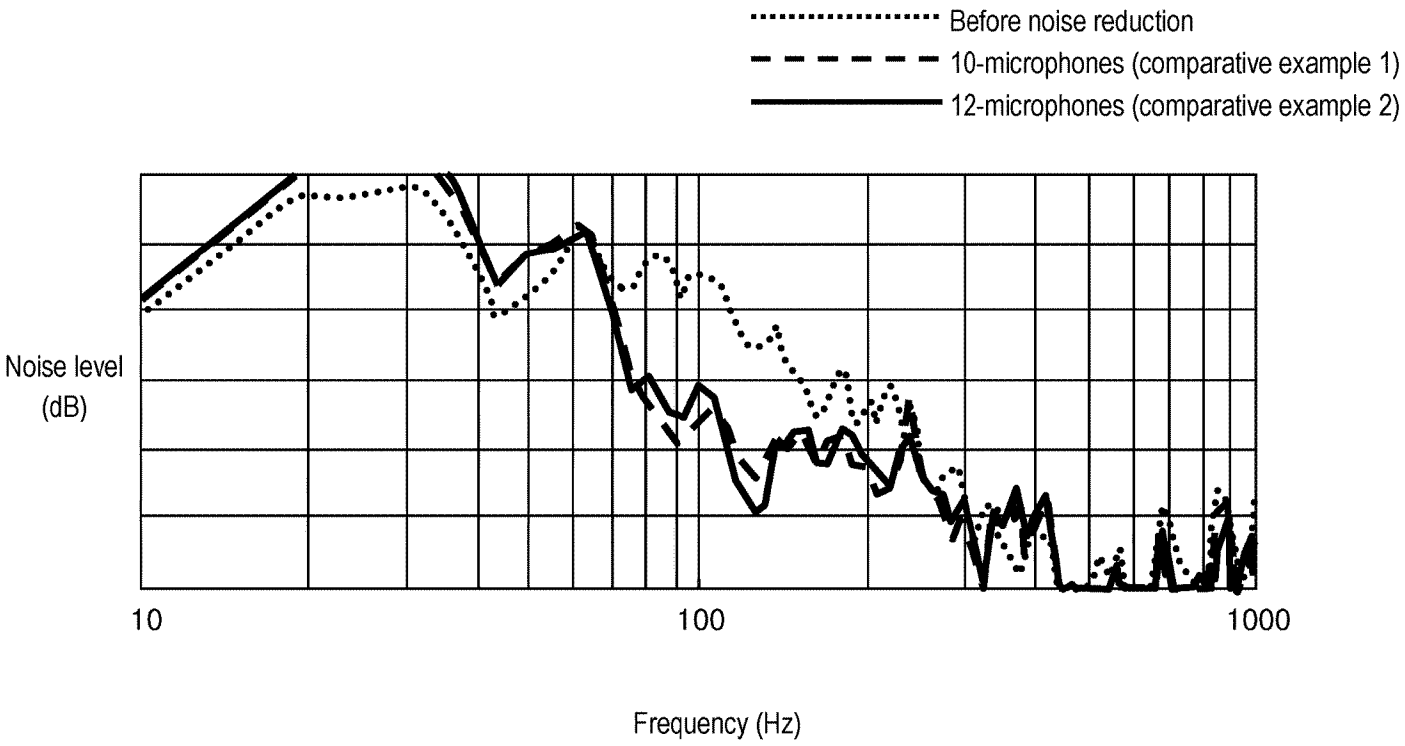
FIG. 11 is a graph illustrating a result of verification of a noise reduction effect of the noise reduction devices of the comparative examples shown in FIGS. 9 and 10.

First, the result is described of verification of the noise reducing effects of the configurations of Comparative Examples 1 and 2, by using the graph shown in FIG. 11.

For the configuration of Comparative Example 1 using ten noise microphones 620*a* to 620*j*, the result shows that the noise reducing effect appears in a frequency band not lower than a frequency of 70 Hz, with the major effect appearing in a frequency band from 70 to 300 Hz.

On the other hand, for the configuration of Comparative Example 2 using twelve noise microphones 620*a* to 620*l*, the result shows that the noise reducing effect appears in a frequency band not lower than a frequency of 70 Hz, and that the approximately equivalent effect to that for Comparative Example 1 describe above is achieved in a frequency band from 70 to 300 Hz.

Figure 12:
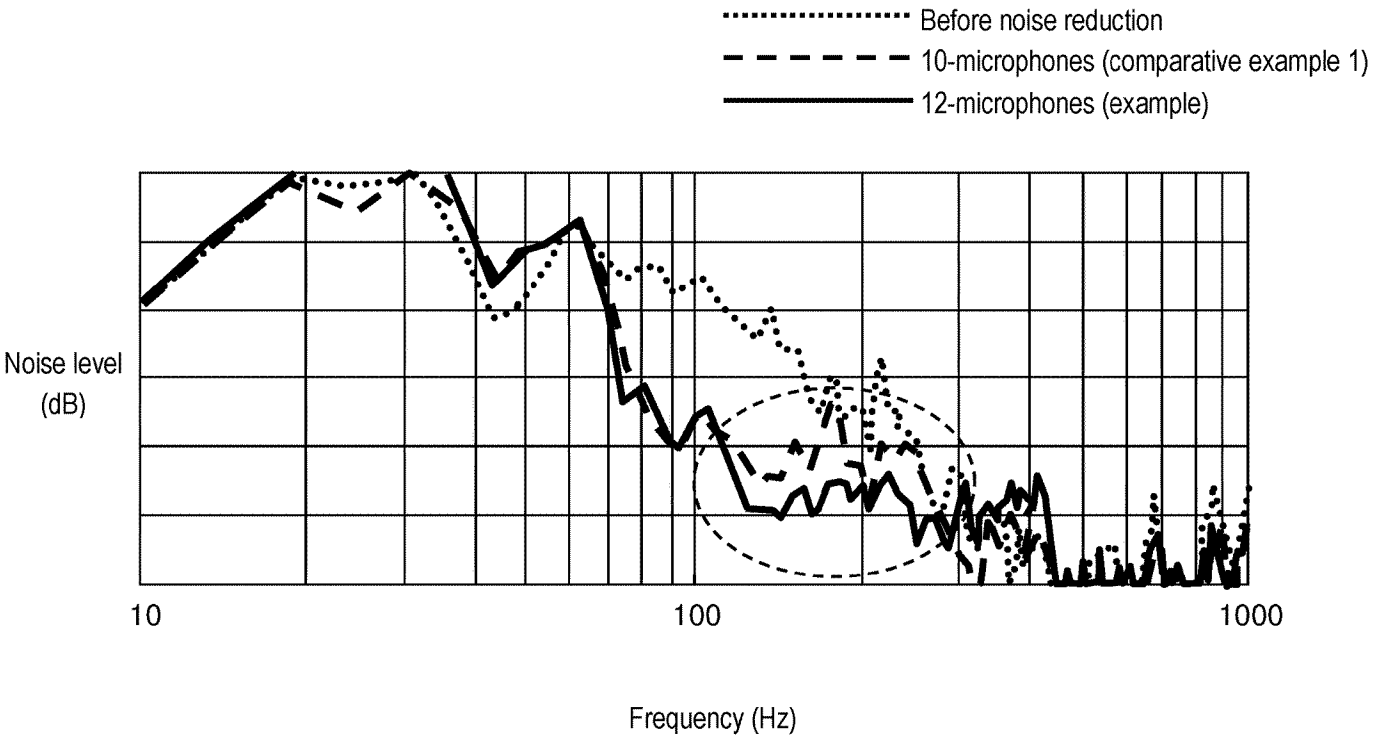
FIG. 12 is a graph illustrating a result of verification of noise reduction effects of the noise reduction device according to the example shown in FIG. 8 and the noise reduction device of the comparative example shown in FIG. 9.

Next, the result is described of verification of the noise reducing effects of the configurations of the Example and Comparative Example 1, by using the graph shown in FIG. 12.

That is, by comparing the result for the configuration of the Example to the result for the configuration of Comparative Example 1 using ten noise microphones 620*a* to 620*j*, it can be seen that the noise reducing effect appears for both configurations in a frequency band from 70 to 300 Hz.

However, particularly in a frequency band from 100 to 300 Hz, the Example is found to be greater in degree of noise reducing effect than Comparative Example 1.

The following factor of the Example is considered to be responsible for this. That is, not all of noise microphones 520*a* to 520*l* are disposed at the positions more distant than distance "d" from the control center, and some of them, i.e. noise microphones 520*a* and 520*b*, are disposed at the positions closer than distance "d" to the control center.

That is to say, in the configuration of the Example, with reference to distance "d" from the control center, two noise microphones 520*a* and 520*b* are disposed at the positions closer than distance "d" to the control center, while more than two noise microphones 520*c* to 520*l* are disposed at the positions more distant than distance "d" from the control center.

With this configuration, it is considered that the correlation can be held in a high level between the noise detected by noise microphones 520*a* to 520*l* and the noise actually reaching the proximity of user's ears, with the causality being satisfied for the noise reduction control. Therefore, even in cases where many noise sources are present and noises come from various directions, as in the cabin of an aircraft, it is possible to effectively reduce the noises over a wide frequency band, from lower to higher frequencies.

Figure 13:
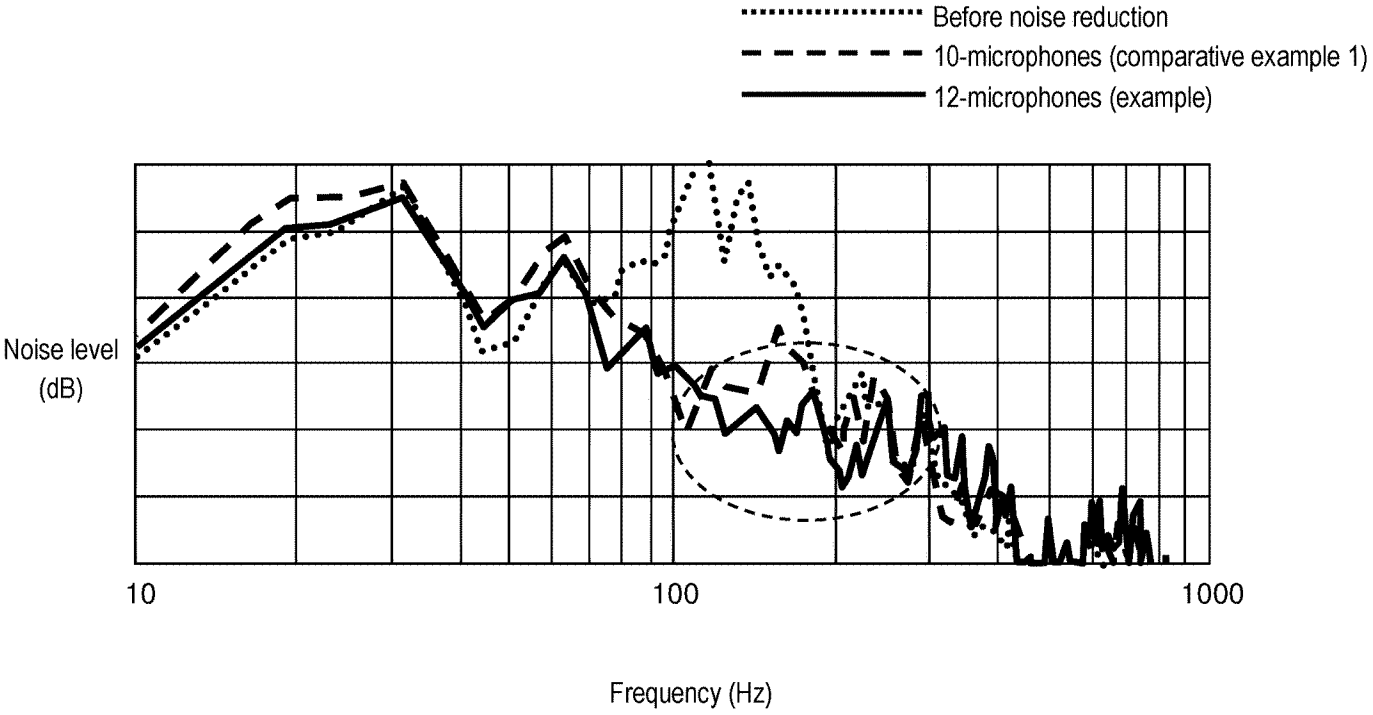
FIG. 13 is a graph illustrating a result of verification of the noise reduction effects of the noise reduction device according to the example shown in FIG. 8 and the noise reduction device of the comparative example shown in FIG. 9.

Likewise, from the graph shown in FIG. 13 of the verification conducted for the case where various conditions (the positions of the noise sources, the presence or absence of the enclosure such as a shell part) are changed from those for the graph shown in FIG. 12, the Example is found to be greater in degree of noise reducing effect than Comparative Example 1 in a frequency band from 100 to 300 Hz.

From the results described above, it can be seen that the configuration according to the embodiment described above provides the more effective noise reduction, compared to the conventional configurations.

Other Exemplary Embodiments

As described above, the first embodiment has been described to exemplify the technology disclosed in the present application. However, the technology is not limited to the embodiment, and is also applicable to embodiments that are subjected, as appropriate, to various changes and modifications, replacements, additions, omissions, and the like. Moreover, the technology disclosed herein also allows another embodiment which is configured by combining the appropriate constituent elements in the first embodiment described above.

Given these factors, other embodiments will be exemplified hereinafter.

(A)

In the embodiment described above, the description has been made using the example in which the arrangement of noise microphone 420*a* and noise microphones 420*b* to 420*g* is determined with reference of distance "d" that is set based on a wavelength of "λ" corresponding to control upper-limit frequency "f" of noise microphones 420*a* to 420*g*, and the like. However, the present disclosure is not limited to this.

Figure 14:
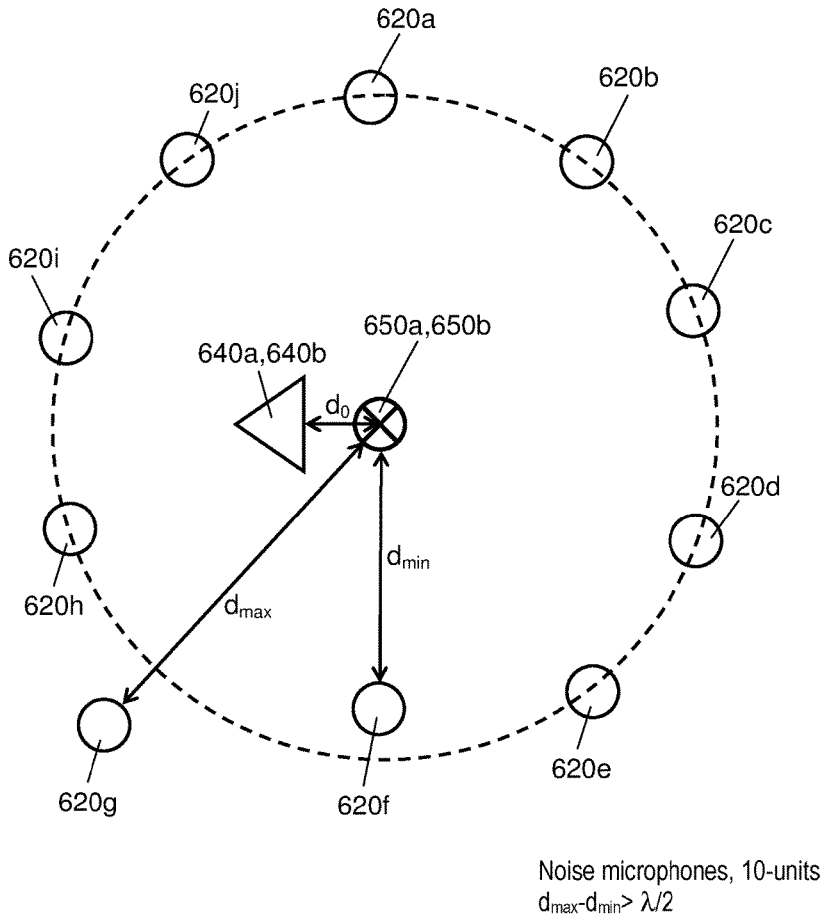
FIG. 14 is a view of an example of an arrangement of noise microphones and the like in a noise reduction device according to another embodiment of the present disclosure.

For example, as shown in FIG. 14, the noise reducing effect is described for the case where ten noise microphones 620*a* to 620*j* are disposed such that their distances from error microphones 650*a* and 650*b* serving as the control center are approximately equal to each other.

In general, in cases where the noise microphones are disposed only at close positions to the control center, causality is not satisfied, resulting in only a little effect on the degree to which low-frequency (e.g. not higher than 300 Hz) sounds are reduced a little.

In contrast, in cases where the noise microphones are disposed only at distant positions from the control center, the causality is satisfied, allowing a noise reducing effect over a wide frequency band. Unfortunately, such a configuration causes a decrease in correlation between the noise detected by the noise microphones and the noise reaching the control center, resulting in a problem, that is, a decrease in sound volume by which the noise is reduced.

In order to enhance the correlation, the noise microphones are preferably disposed closer to the control center within a range of distance "da" indicated by Relational Expression (4). On the other hand, however, in order to satisfy the causality, distance "db" indicated by Relational Expression (5) needs to be satisfied. Accordingly, in the case where many noise microphones are disposed, the arrangement in which the distances of the noise microphones are approximately equal to each other within a range between distances "da" and "db," can enhance the noise reducing effect more greatly. This is because a favorable interaction between the effect of satisfying the causality and the effect of enhancing the correlation.

Note that, "λ" is a wavelength corresponding to control upper-limit frequency "f" of noise microphones 620*a* to 620*j*, "t" is a control delay time in the control speakers, and "v" is a sound speed.

That is, such approximately equal distances in the arrangement allows Relational Expression (6) to be satisfied, as shown in FIG. 14, where distance "dmax" is the distance of noise microphone 620*g* disposed at the most distant position from the control center, and distance "dmin" is the distance of noise microphone 620*f* disposed at the closest position to the control center. That is, $$da=d0+t\times v-\lambda/2, \tag{4}$$

$$db=d0+t\times v, \tag{5}$$

$$d\max-d\min<\lambda/2. \tag{6}$$

Note that, in a case where the control delay time of the speakers is not known, Relational Expressions (4) and (5) cannot be determined. Even with such a case, however, a number of noise microphones can be disposed to have approximately equal distances (within the range indicated by Relational Expression (6)), thereby effectively reducing noises with the smaller number of the microphones than is usually expected.

Here, if applying the configuration of this embodiment to the aforementioned configuration of the embodiment shown in FIG. 4, the aforementioned configuration can be seen to correspond to the arrangement in which noise microphones 420*b* to 420*g*, excluding noise microphones 420*a*, are disposed at the distances approximately equal to each other from either error microphones 450*a* or 450*b* serving as the control center.

Figure 15:
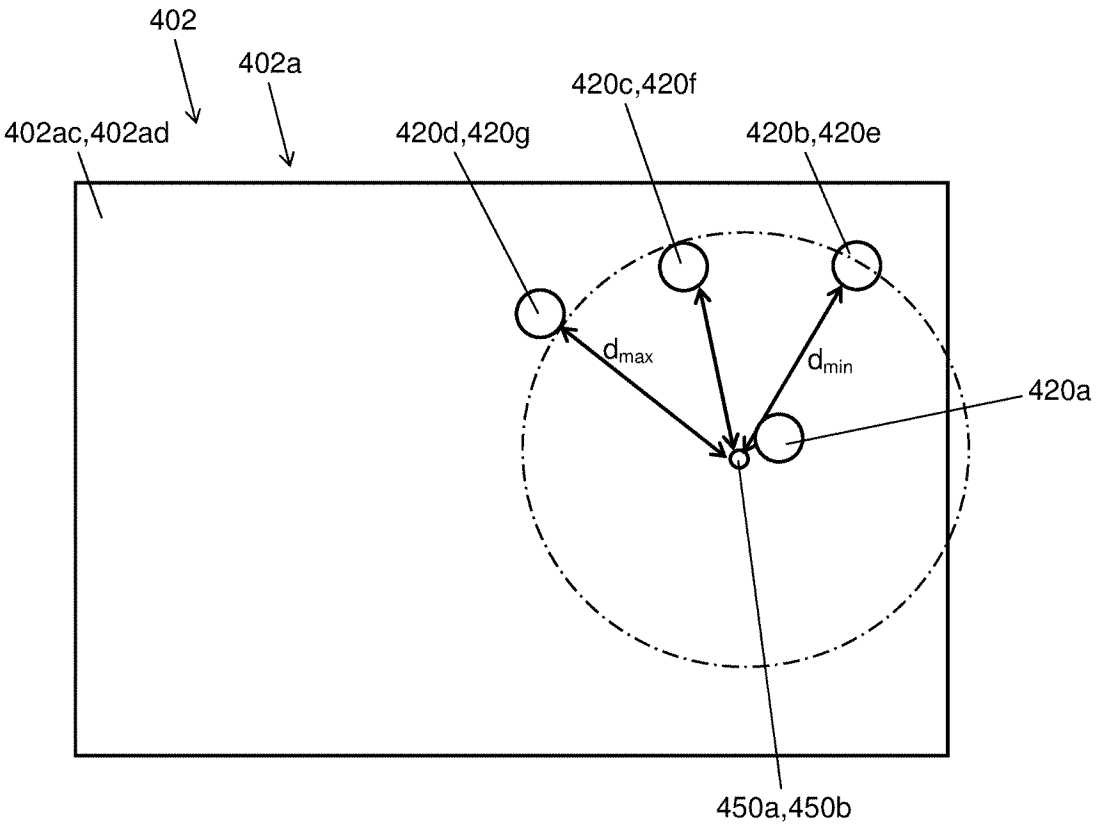
FIG. 15 is a view of an example of an arrangement of noise microphones and the like in a noise reduction device according to further another embodiment of the disclosure.

FIG. 15 is a side-elevational view of FIG. 4, showing an example of the arrangement in which noise microphones 420*b* to 420*d* are disposed at approximately equal distances from error microphones 450*a*, and noise microphones 420*e* to 420*g* are disposed at approximately equal distances from error microphones 450*b*.

In this way, when a plurality of the control centers is present, it is only required for the noise microphones to be disposed at approximately equal distances to each other from the respective control centers; therefore, the arrangement of the noise microphones is not limited to that described above.

For example, the midpoint between error microphones 450*a* and error microphones 450*b* may be regarded as a control center from which the distances of the noise microphones are determined to be approximately equal to each other. Alternatively, only either control center 450*a* or 450*b* may be regarded as the control center.

Figure 16:
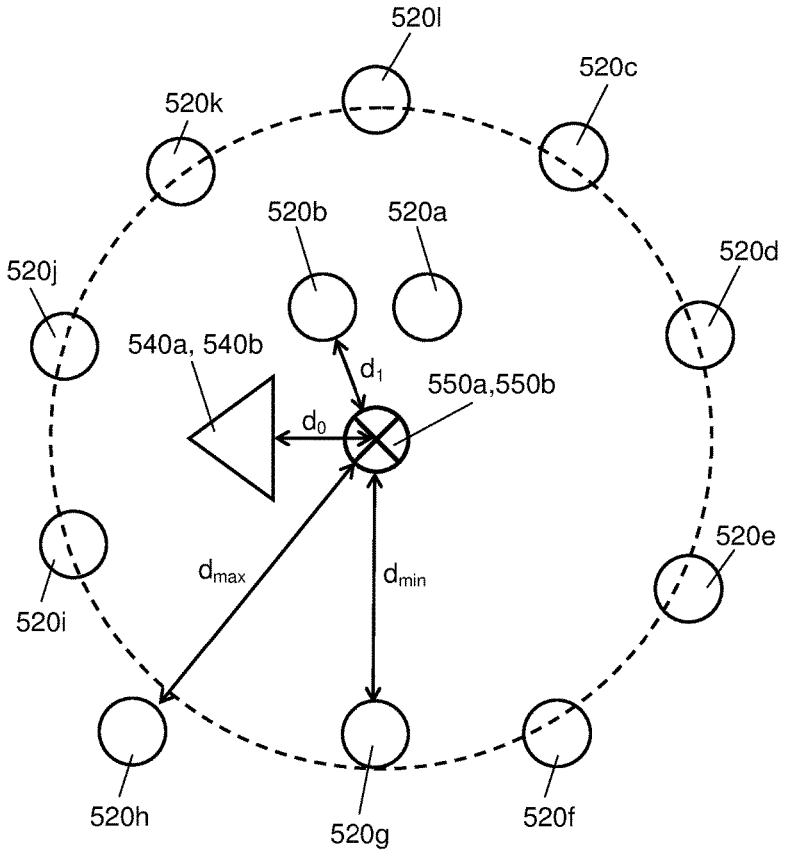
FIG. 16 is a view of an example of an arrangement of noise microphones and the like in a noise reduction device according to still another embodiment of the disclosure.

Moreover, as shown in FIG. 16, in addition to the many noise microphones disposed at the approximately equal distances in the same way as for the embodiment described above, additional noise microphones may be disposed at distances closer than distance "dmin" to the control center. The additional noise microphones are smaller in number than the many noise microphones.

With this configuration, even in cases where many noise sources are present and noises come from various directions due to reverberations and the like, as in the cabin of an aircraft, it is possible to effectively reduce the noises over a wide frequency band, from lower to higher frequencies. Note that, in the configurations shown in FIGS. 4 and 15, noise microphone 420*a* corresponds to the microphone disposed at the closest position.

(B)

In the other embodiment (A) described above, the description has been made regarding the example in which noise microphones 420*b* to 420*g* are disposed in side walls 402*ac* and 402*ad* of shell part 402*a* installed in the aircraft such that the distances of the microphones are approximately equal to each other from the control center. However, the present disclosure is not limited to this.

Figure 17:
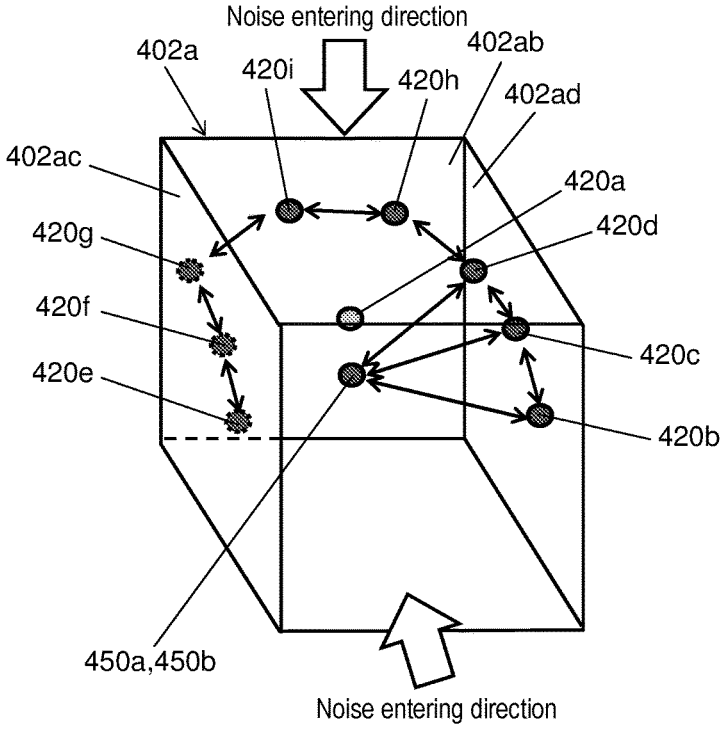
FIG. 17 is a view of an example of an arrangement of noise microphones and the like in a noise reduction device according to yet another embodiment of the disclosure.

FIG. 17 shows the configuration of a shell part devoid of front wall 402*aa*, in comparison with the configuration shown in FIG. 4, illustrating the case where major noises come from opened directions, i.e. the front and top directions. For example, in addition to noise microphones 420*b* to 420*g* disposed in side walls 402*ac* and 402*ad* of shell part 402*a*, noise microphones 420*h* and 420*i* may be disposed in back wall 402*ab* of shell part 402*a*, as shown in FIG. 17.

Even in this case, the noise microphones may be disposed in such a manner that: Noise microphones 420*b* to 420*i* are disposed such that the distances from the control center are approximately equal to each other, and noise microphones 420*b* to 420*i* are disposed at spacing intervals approximately equal to each other, with each of the spacing intervals being a distance between adjacent two of the noise microphones. This configuration allows the same noise reducing effect as that described above, on the inside of shell part 402*a* where the noise-entering directions are restricted to some extent.

Figure 18:
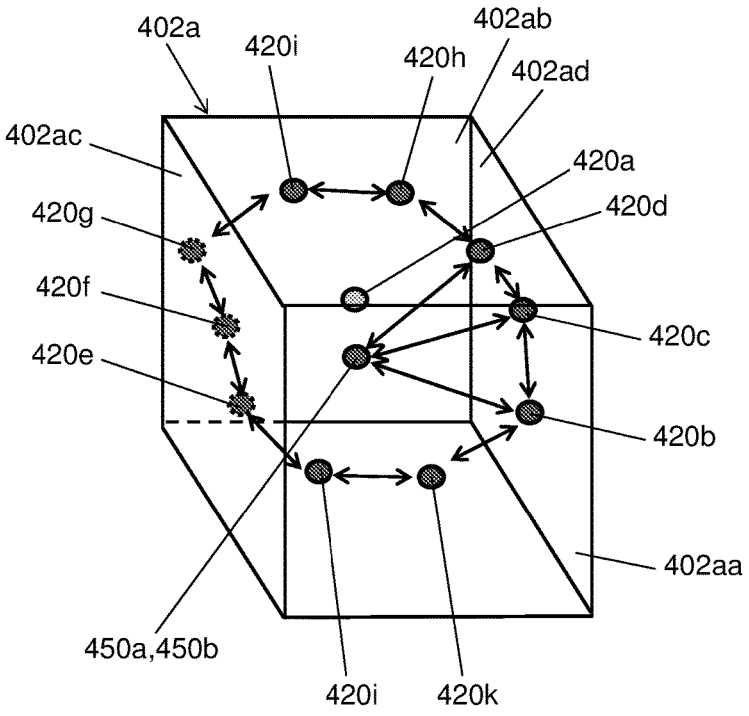
FIG. 18 is a view of an example of an arrangement of noise microphones and the like in a noise reduction device according to another embodiment of the disclosure.

Moreover, FIG. 18 shows an example in which front wall 402*aa* is present in addition to the configuration shown in FIG. 17. In this case, noise microphones 420*j* and 420*k* may be additionally disposed in front wall 402*aa* of shell part 402*a*.

Even in this case, the noise microphones may be disposed in such a manner that: Noise microphones 420*b* to 420*k* are disposed such that the distances from the control center are approximately equal to each other, and noise microphones 420*b* to 420*k* are disposed at spacing intervals approximately equal to each other, with each of the spacing intervals being a distance between adjacent two of the noise microphones. This configuration allows the same noise reducing effect as that described above, on the inside of shell part 402*a* where the noise-entering directions are restricted to some extent.

Figure 19:
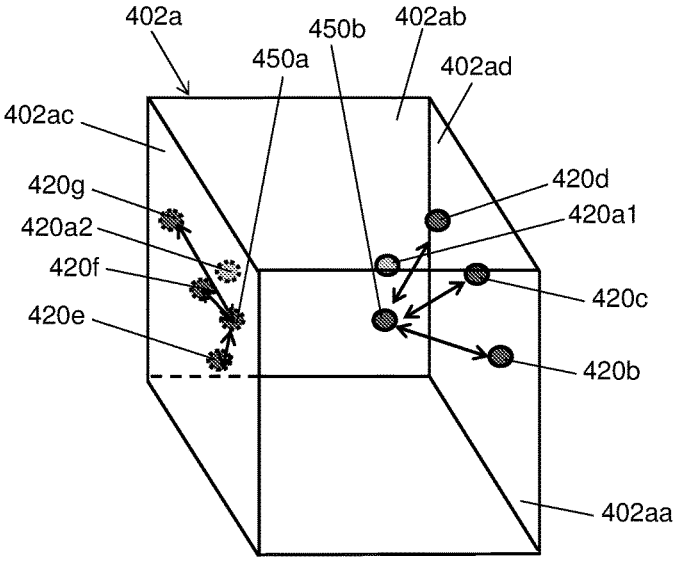
FIG. 19 is a view of an example of an arrangement of noise microphones and the like in a noise reduction device according to further another embodiment of the disclosure.

Furthermore, as shown in FIG. 19, a plurality of error microphones 450*a* and 450*b* may be disposed, and noise microphones 420*a*1 and 420*a*2 for short range use may be disposed in the proximity of error microphones 450*a* and 450*b*, respectively.

Even in this case, the noise microphones may be disposed in such a manner that: Noise microphones 420*b* to 420*d* are disposed such that the distances from the control center (error microphones 450*b*) are approximately equal to each other; noise microphones 420*e* to 420*g* are disposed such that the distances from the control center (error microphones 450*a*) are approximately equal to each other; noise microphones 420*b* to 420*d* are disposed at spacing intervals approximately equal to each other, with each of the spacing intervals being a distance between adjacent two of the noise microphones; and noise microphones 420*e* to 420*g* are disposed at spacing intervals approximately equal to each other, with each of the spacing intervals being a distance between adjacent two of the noise microphones. This configuration allows the same noise reducing effect as that described above.

Figure 20A:
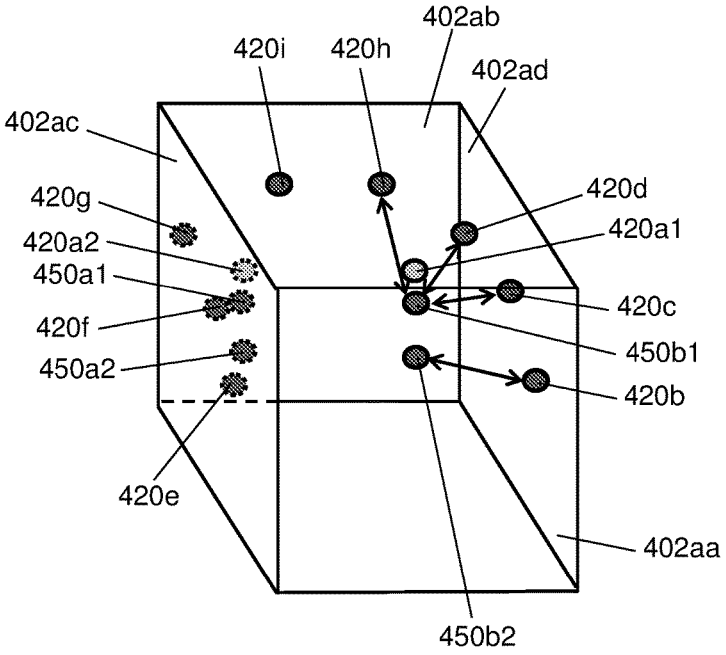
FIG. 20A is a perspective view of an example of an arrangement of noise microphones and the like in a noise reduction device according to still another embodiment of the disclosure.
Figure 20B:
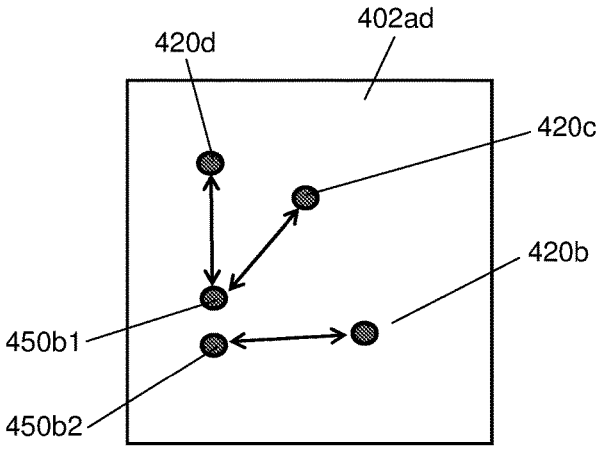
FIG. 20B is a side-elevational view of the example of the arrangement of the noise microphones and the like in the noise reduction device according to the still another embodiment of the disclosure.

Moreover, as shown in FIGS. 20A and 20B, the configuration may be such that error microphones 450*a*1 and 450*a*2 are disposed on the side wall 402*ac* side and that error microphones 450*b*1 and 450*b*2 are disposed on the side wall 402*ad* side.

In this case, in corresponding with these error microphones, noise microphones are only required to be disposed in such a manner that: Concerning error microphones 450*a*1 and 450*a*2 on the side wall 402*ac* side, noise microphones 420*e* to 420*g* are disposed such that distances are approximately equal to each other, with each of the distances being measured between the noise microphone and either error microphones 450*a*1 or 450*a*2 whichever is closer to the noise microphone. In addition, as shown in FIG. 20B, concerning error microphones 450*b*1 and 450*b*2 on the side wall 402*ad* side, noise microphones 420*b* to 420*d* are disposed such that distances are approximately equal to each other, with each of the distances being measured between the noise microphone and either error microphones 450*b*1 or 450*b*2 whichever is closer to the noise microphone.

Alternatively, for these error microphones, the noise microphones may be disposed in such a manner that: On the side wall 402*ac* side, either error microphones 450*a*1 or 450*a*2 is regarded as a reference, and the noise microphones are disposed such that the distances from the reference to the noise microphones are approximately equal to each other. In addition, on the side wall 402*ad* side, either error microphones 450*b*1 or 450*b*2 is regarded as a reference, and the noise microphones are disposed such that the distances from the reference to the noise microphones are approximately equal to each other.

Figure 21:
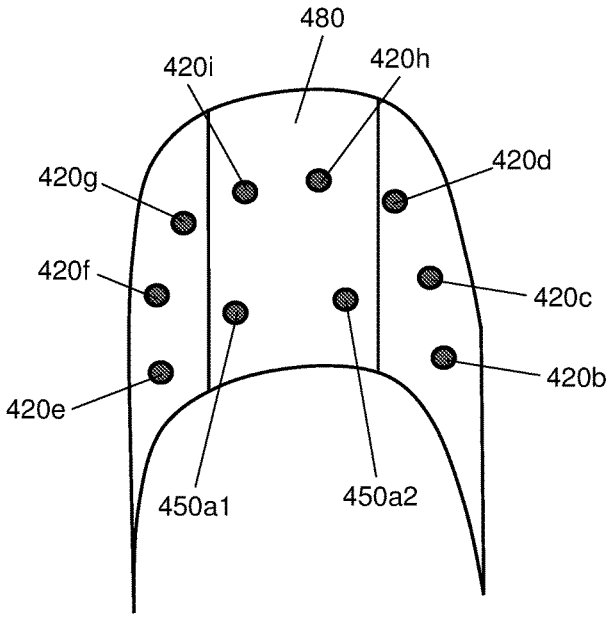
FIG. 21 is a view of an example of an arrangement of noise microphones and the like in a noise reduction device according to yet another embodiment of the disclosure.

Moreover, as shown in FIG. 21, in the case where shell part 480 has a hood-like shape, noise microphones 420*b* to 420*i* may be disposed such that distances from either error microphones 450*a*1 or 450*a*2 to the noise microphones are approximately equal to each other.

Note that, in this case, noise microphones 420*b* to 420*i* are preferably disposed at spacing intervals approximately equal to each other, with each of the spacing intervals being a distance between adjacent two of the noise microphones.

This configuration allows the noise reducing effect on the inside of shell part 480 described above.

(C)

In the above embodiments, the descriptions have been made using the example in which the noise reducing control is performed provided that the influence of the control sounds on noise microphones 420*a* to 420*g* (particularly, noise microphone 420*a*) can be neglected, with the control sound having the opposite phase to the noise and being emitted from control speakers 440*a* and 440*b*. However, the present disclosure is not limited to this.

Figure 22:
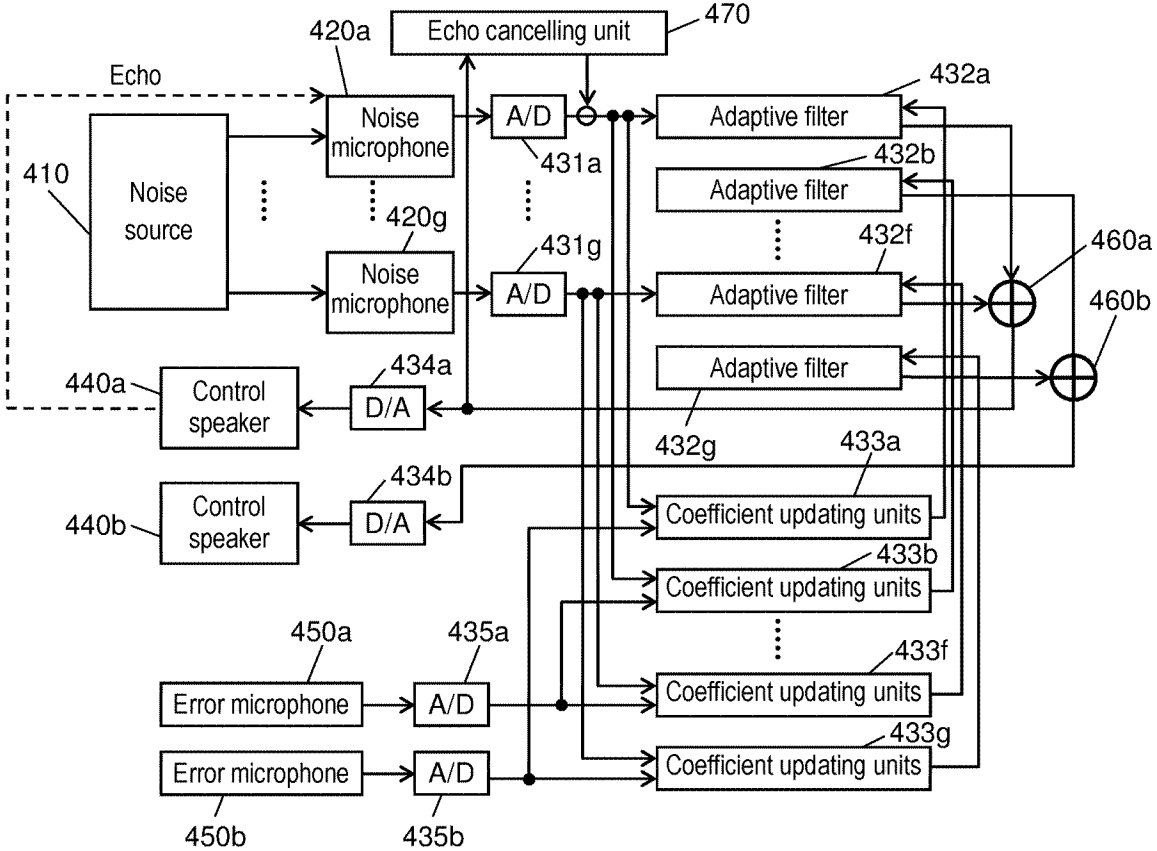
FIG. 22 is a block diagram of a configuration of a noise reduction device according to another embodiment of the disclosure.

For example, a phenomenon concerned here is that noise microphones 420*a* to 420*g* will detect the control sound having the opposite phase to the noise, with the control sound being emitted from control speakers 440*a* and 440*b*. This may prevent the noise microphones from correctly detecting the actual noise. To prevent such an incorrect detection, as shown in FIG. 22, echo cancelling unit 470 may be disposed to cancel the control sound detected by noise microphones 420*a* to 420*g*.

Echo cancelling unit 470 performs echo cancelling processing in such a manner that: As shown in FIG. 22, the echo cancelling unit receives an echo signal of the control sound emitted from control speaker 440*a*. Then, in accordance with the echo signal, the echo cancelling unit cancels part of the output from noise microphone 420*a*, with the part corresponding to the echo signal.

Specifically, echo cancelling unit 470 is disposed and designated for noise microphones 420*a* for a lower frequency range. Moreover, in the echo cancelling, echo cancelling unit 470 measures a transfer function, in advance, which can express the characteristics of an involved system until the output from control speaker 440*a* is detected by noise microphone 420*a*. The echo cancelling unit approximates such a transfer function by means of a finite impulse response (FIR) filter. Then, the echo cancelling unit passes the output of control speaker 440*a* through the FIR filter, thereby subjecting the output to the transfer function. The resulting output signal is then subtracted from the input from noise microphone 420*a*, thereby completing the echo cancelling processing.

With this configuration, it is possible to cancel the sound, which corresponds to the control sound, from the noise detected by noise microphone 420*a* that is disposed at a close position to the control speaker 440*a*. Therefore, even in the case where noise microphone 420*a* is disposed at such a close position to control speaker 440*a*, the noise microphone can correctly detect the noise without being subjected to the influence of the control sound.

Note that, in the configuration shown in FIG. 22, echo cancelling unit 470 is disposed at the part corresponding to both control speaker 440*a* and noise microphone 420*a*. However, the echo cancelling unit may be disposed at a part corresponding to all of the noise microphones which are disposed at positions close to the control center (error microphones 450*a* and 450*b*).

Alternatively, the echo cancelling unit may be disposed at a part corresponding to all of the noise microphones, independently of the distances from the control center.

(D)

In the embodiments, the descriptions have been made using the example in which seven noise microphones 420*a* to 420*g* commonly employ the wide-band microphones, without distinguishing their frequency ranges between low and high frequencies. However, the present disclosure is not limited to this.

For example, a low pass filter (LPF) passing sounds of only lower frequencies may be disposed in a pre-stage part of the coefficient updating unit that corresponds to the noise microphone disposed at a position closer than distance "d" describe above. In addition, a high pass filter (HPF) passing sounds of only higher frequencies may be disposed in a pre-stage part of the coefficient updating unit that corresponds to the noise microphone disposed at a position more distant than distance "d" describe above.

With this configuration, the noise microphones disposed at the positions closer than distance "d" can be used as ones for lower frequencies, while the noise microphones disposed at the positions more distant than distance "d" can be used as ones for higher frequencies.

(E)

In the embodiments described above, the descriptions have been made using the example in which the noise detecting units for detecting the noise are noise microphones 420*a* to 420*g*, etc. However, the present disclosure is not limited to this.

For example, vibration sensors and the like may be used instead of these microphones.

(F)

In the embodiments described above, the descriptions have been made using the example in which the noise reduction device according to the present disclosure is installed in the cabin of aircraft 100. However, the present disclosure is not limited to this.

The installation site of the noise reduction device is not limited to the cabin of an aircraft. For example, the noise reduction device may be installed in the cockpit of the aircraft, for reducing a burden on ears of a pilot. Alternatively, the noise reduction device may be installed in vehicles other than aircraft, including helicopters, trains, and buses. Moreover, besides movable bodies such as vehicles, the noise reduction device may be installed in other places including buildings located in the neighborhood of, such as, a construction site or a club with live music which emits a noise.

Note that, because the aforementioned embodiments are used only for the exemplification of the technology according to the present disclosure, it is to be understood that various changes and modifications, replacements, additions, omissions, and the like may be made to the embodiments without departing from the scope of the appended claims or the scope of their equivalents.

The noise reduction device according to the present disclosure provides the advantage of effectively reducing noises over a wide frequency band, from lower to higher frequencies, even in cases where many noise sources are present and/or noises come from various directions due to strong reverberations, such as in seats in aircraft cabins. Therefore, the noise reduction device is widely applicable to noise reduction devices installed at various locations.

What is claimed is:

1. A noise reduction device, comprising:

a plurality of noise detecting units for detecting a noise;

a noise controller for generating a control-sound signal to reduce, at a control center of a control space, the noise detected by the plurality of noise detecting units; and a control-sound outputting unit for outputting a sound based on the control-sound signal, wherein (i) a number of the plurality of noise detecting units which is disposed at a distance, from the control center, shorter than a distance "d," is smaller than (ii) a number of the plurality of noise detecting units which is disposed at a distance, from the control center, longer than the distance "d," and wherein "d" is a distance from the control center to a reference noise detecting unit and is indicated by Relational Expression $$d=d0+t\times v-\lambda/2$$

where "λ" is a wavelength corresponding to control upper-limit frequency "f" in the noise detecting units, "d0" is a distance from the control center to the control-sound outputting unit, "t" is a control delay time in the control-sound outputting unit, and "v" is a sound speed.

2. The noise reduction device according to claim 1, wherein, of the plurality of the noise detecting units, the noise detecting units disposed at the distances longer than the distance "d" from the control center are disposed at spacing intervals between the noise detecting units adjacent to each other, the intervals being substantially equal to each other.

3. The noise reduction device according to claim 1, wherein the noise controller performs feed-forward control.

4. The noise reduction device according to claim 1, wherein at least one of the plurality of noise detecting units is disposed at a distance, from the control center, shorter than the distance "d".

5. A noise reduction device, comprising:

a plurality of noise detecting units for detecting a noise;

a noise controller for generating a control-sound signal to reduce, at a control center of a control space, the noise detected by the plurality of noise detecting units; and a control-sound outputting unit for outputting a sound based on the control-sound signal, wherein distances between each of the plurality of noise detecting units and the control center, satisfies Relational Expression $$d\max - d\min < \lambda/2$$

where "dmax" is a distance from the control center to one, most distant from the control center, of the plurality of noise detecting units; "dmin" is a distance from the control center to one, closest to the control center, of the plurality of noise detecting units; and "λ" is a wavelength corresponding to control upper-limit frequency "f" in the plurality of noise detecting units.

* * * * *